US008733377B2

(12) United States Patent
Zhang et al.

(10) Patent No.: US 8,733,377 B2
(45) Date of Patent: May 27, 2014

(54) ACOUSTIC CLEANING DEVICE WITH VARIABLE LENGTH TO COMPENSATE APPLICATION TEMPERATURE

(75) Inventors: Tian Xuan Zhang, Overland Park, KS (US); David Michael Chapin, Overland Park, KS (US)

(73) Assignee: BHA Altair, LLC, Franklin, TN (US)

( * ) Notice: Subject to any disclaimer, the term of this patent is extended or adjusted under 35 U.S.C. 154(b) by 609 days.

(21) Appl. No.: 12/966,180

(22) Filed: Dec. 13, 2010

(65) Prior Publication Data

US 2012/0145182 A1 Jun. 14, 2012

(51) Int. Cl.

| | |
|---|---|
| ***B08B 3/12*** | (2006.01) |
| ***D06G 1/00*** | (2006.01) |
| ***A47L 7/00*** | (2006.01) |

(52) U.S. Cl.
USPC ..... 134/184; 165/95; 116/137 R

(58) Field of Classification Search
USPC ..... 134/1, 184; 367/137, 138, 144; 116/137 R, 138, 139; 165/95
See application file for complete search history.

(56) References Cited

U.S. PATENT DOCUMENTS

| | | | | |
|---|---|---|---|---|
| 2,354,684 | A * | 8/1944 | Jones et al. | 116/147 |
| 3,477,405 | A * | 11/1969 | Jensen | 116/137 R |
| 4,461,651 | A * | 7/1984 | Hall | 134/1 |
| 6,964,709 | B2 * | 11/2005 | Matsumoto et al. | 134/1 |
| 2002/0118601 | A1 | 8/2002 | Freund | |

* cited by examiner

*Primary Examiner* — Saeed T Chaudhry
(74) *Attorney, Agent, or Firm* — Reinhart Boerner Van Deuren P.C.

(57) ABSTRACT

An acoustic cleaning system includes an operating device having an interior portion. An acoustic cleaning device provides for the passage of a sound wave into the interior portion of the operating device. The acoustic cleaning device includes a horn section attached to an elongated section having a linear or non-linear shape. Sound waves are configured to pass from the elongated section to the horn section and into the interior portion of the operating device. The elongated section is removable from the horn section such that the elongated section is interchangeable with an elongated section having a different length, such that the sound waves are configured to have a frequency between 55 Hz to 75 Hz depending on a temperature of the operating device.

18 Claims, 9 Drawing Sheets

ACOUSTIC CLEANING DEVICE WITH VARIABLE LENGTH TO COMPENSATE APPLICATION TEMPERATURE

BACKGROUND OF THE INVENTION

1. Field of the Invention

The invention relates to cleaning devices for agitating dirt and, more particularly, to an acoustic cleaning device that delivers a low frequency sound wave in a high-temperature operating device to agitate dirt within the operating device.

2. Discussion of Prior Art

High-temperature operating devices may include baghouses, heat exchangers, boilers, selective catalytic reduction devices, etc. Particles, such as dust, dirt, and the like, may accumulate both in the air and on walls and structures within the high-temperature operating device. A flue gas may pass through the high-temperature operating device to carry the airborne particles away. However, the flue gas is less effective at removing particles that have accumulated on walls and structures. Acoustic cleaning devices have been used to emit a sound wave into the operating devices and agitate the particles, thus dislodging the particles from interior walls of the operating device. Once the particles are agitated, the flue gas may pass through the high-temperature operating device and carry the particles away. However, the effective fundamental frequency of the sound waves increases as the temperature of the operating device increases. A lower frequency produces more effective vibration for removing deposits. It would be useful to have an acoustic cleaning device that produces consistently low frequency sound waves when cleaning in a high-temperature operating device, regardless of the temperature of the operating device.

Thus, a method and device for lowering the frequency emitted from an acoustic cleaner into an operating device is beneficial. This method/device should be able to do so without creating the need for significantly more space to contain the acoustic cleaner and without taking up much space outside the operating device. Since there are so many acoustic cleaners already installed globally, this system should also allow ease of retrofit to existing acoustic cleaners to make them more effective at cleaning.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In accordance with one aspect the present invention provides an acoustic cleaning device providing sound waves to an operating device. The acoustic cleaning device includes a horn section configured to emit sound waves, and an elongated section attached to the horn section, wherein the horn section is in operative association with the operating device, such that the sound waves emitted from the horn section are configured to pass into an interior portion of the operating device to agitate particles within the operating device.

In accordance with another aspect the present invention provides an acoustic cleaning system including an operating device including an interior portion, an acoustic cleaning device in operative association with the operating device, the acoustic cleaning device including a horn section attached to an elongated section having a linear or non-linear shape, wherein sound waves are configured to pass from the elongated section to the horn section and into the interior portion of the operating device, wherein the elongated section is removably interchangeable with an elongated section having a different length, such that the perceived sound waves are configured to have a frequency between 55 Hz to 75 Hz depending on a temperature of the operating device.

In accordance with another aspect of the present invention provides a method of providing sound waves to agitate particles within an operating device, the method including providing a horn section for emitting sound waves, attaching an elongated section of a pre-determined length to the horn section, wherein the elongated section is non-linearly shaped, attaching the horn section to the operating device, selecting the pre-determined length of the elongated section based on a temperature of the operating device such that a frequency of the sound waves is between 55 Hz to 75 Hz, and agitating air within the operating device by the sound waves, such that particles within the operating device are agitated.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
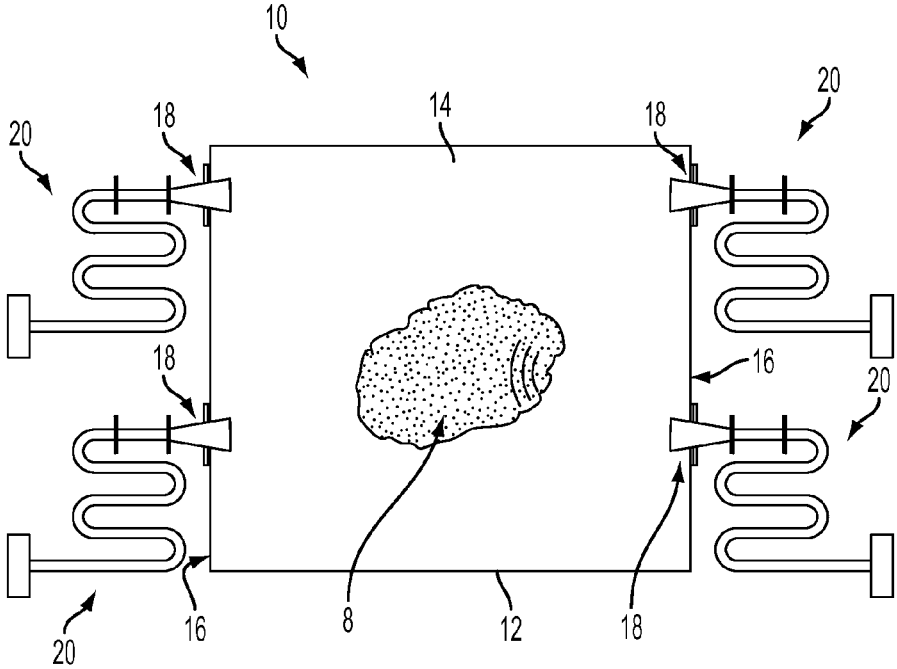
FIG. 1 is a sectional side view of an example operating device with example acoustic cleaning devices shown.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

FIG. 1 illustrates an acoustic cleaning system 10 according to one aspect of the invention and in association with an operating device 12. The acoustic cleaning system 10 may include one or more acoustic cleaning devices 20 associated with the operating device 12. Within the shown example, four acoustic cleaning devices 20 are associated with the operating device 12.

It is to be appreciated that the operating device 12 is only generically/schematically shown and may be varied in construction and function. The operating device 12 may include a variety of high-temperature devices including, but not limited to, boilers, heat exchangers, selective catalyst reduction (SCR), electrostatic precipitator (ESP), baghouses, cooling towers, spray towers, fans, etc. Similarly, the operating device 12 can vary between a wide range of high-temperatures depending on the device. For instance, SCR devices can operate at around 700° F., while boilers and heat exchangers may reach temperatures of 1000° F. and higher. As such, the operating device 12 need not be a specific limitation upon the present invention.

The operating device 12 is defined by one or more walls 16, and may further include one or more holes 18 extending through the one or more walls 16. In the shown example, there are four holes, however, it is to be understood, that more than four holes, or as few as one hole may be provided. The holes 18 can provide an opening for sound waves to emanate from the acoustic cleaning device 20 to the interior portion 14 of the operating device 12.

Particles 8, such as dust, dirt, ash, soot, or the like, may accumulate on the walls 16 or structures (not shown) of an interior portion 14 of the operating device 12. To remove the particles 8, a flue gas can pass through the operating device 12 to carry the particles away. However, particles 8 accumulating on the walls and/or structures of the interior portion 14 are more difficult to remove. Therefore, an example of the acoustic cleaning device 20 can be used to agitate the particles in the operating device 12 by delivering a sound wave into the interior portion 14. Once agitated, the particles are dislodged from the walls and/or structure within the interior portion 14 and, once airborne, can be more easily removed with the flue gas passing through the operating device 12.

Figure 2:
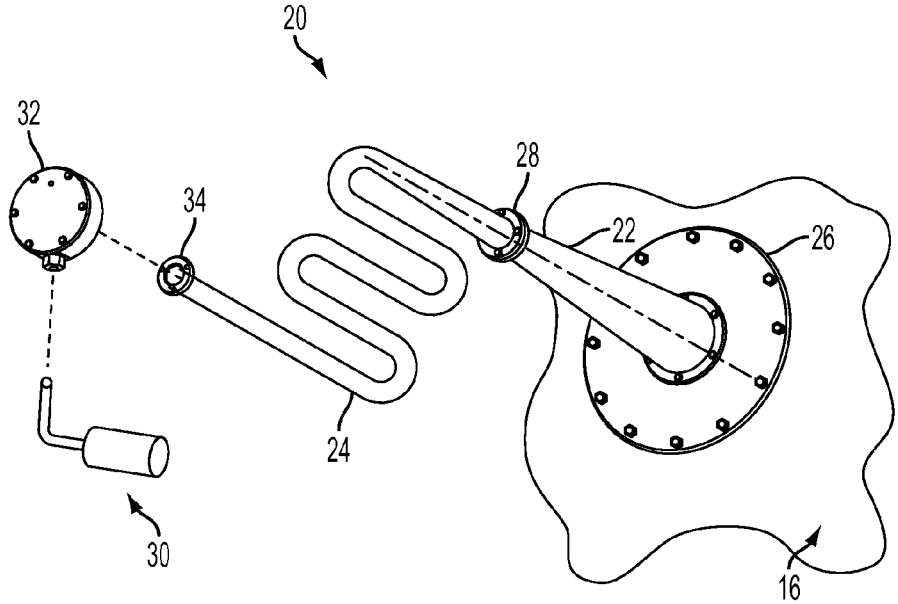
FIG. 2 is a partially exploded view of an example acoustic cleaning device attached to a wall of the operating device of FIG. 1.

Referring now to FIG. 2, an example of the acoustic cleaning device 20 is shown in attachment with the wall 16 of the operating device 12. The acoustic cleaning device 20 may include a horn section 22 configured to emit sound waves and an elongated section 24 attached to the horn section 22. The horn section 22 can be conically shaped with a hollow center extending axially along the length of the horn section 22. The horn section 22 may further include a smaller diameter end and a larger diameter end. The smaller diameter end may be positioned adjacent to and in engagement with the elongated section 24. The larger diameter end may be positioned adjacent to and in engagement with the wall 16 of the operating device 12.

The horn section 22 can be attached to the wall 16 in such a way that the hollow center of the horn section 22 aligns with the one or more holes 18 in the wall 16. The acoustic cleaning device 20 can be attached to the wall 16 of the operating device 12 in a number of ways. For example, as shown in FIG. 2, the horn section 22 can be attached to the wall 16 by a flange 26 and a plurality of screws. However, other possible attachment means are envisioned, such as a male-female threading attachment, a snap fit attachment, etc. The wall 16 may include one or more threaded holes (not shown) for receiving the plurality of screws from the flange 26. As such the acoustic cleaning device 20 may be removably attachable to the wall such that the acoustic cleaning device 20 may be freely attachable and detachable from the wall 16. Consequently, the horn section 22 may be removed from the wall 16 such that the acoustic cleaning device 20 is interchangeable with a separate acoustic cleaning device having a different length and/or shape.

The horn section 22 can be attached adjacent to the wall 16 such that the end of the horn section 22 is substantially flush with the wall 16. In another alternative, as shown in FIG. 1, the horn section 22 may extend partially into the interior portion 14 of the operating device 12. In this example, as shown in FIG. 1, the acoustic cleaning device 20 may extend at least partially through the one or more holes 18 formed in the wall 16 such that the end of the horn section 22 can be positioned within the interior portion 14 of the operating device 12. In this example, an attachment means, such as a flange, male-female threading attachment, a snap fit attachment, etc. may hold the horn section 22 in place against the wall 16 while the end of the horn section 22 protrudes into the interior portion 14.

Referring still to FIG. 2, the acoustic cleaning device 20 may further include the elongated section 24 attached to the horn section 22. The elongated section 24 may be an elongated tube defining a hollow center that extends axially along the length of the elongated section 24. The elongated section 24 can be linear in shape, such as having a straight section, or further includes one or more bends or curves and be non-linear in shape, as will be discussed below. The elongated section 24 may be attached to the horn section 22 by a variety of attachment means, such as a flange 28 (shown in FIG. 2), a male-female threading attachment, a snap fit attachment, or the like. The flange 28 may include one or more screws for engaging corresponding holes in the horn section 22. Thus, the elongated section 24 may be removably attachable from the horn section 22 and may be interchangeable with a separate elongated section having a different length and/or shape. In one example, the elongated section 24 and horn section 22 may be formed as a single, integrally formed piece, such that the flange 28 is not necessary. However, in the shown example of FIG. 2, the elongated section 24 and horn section 22 are shown as two separate pieces. Similarly, the elongated section 24 may be formed as a single piece, or, in the alternative, may be formed from one or more pieces joined together, such as by an attachment means, including a flange, male-female threading attachment, a snap fit attachment, etc.

Referring still to FIG. 2, the acoustic cleaning device 20 may further include a compressor 30 and an acoustic driver 32. The compressor 30 can transmit pressurized or compressed air to the acoustic driver 32. As such, the compressor 30 is in operative association with the elongated section 24 and is configured to push air through the elongated section. It is to be understood that the compressor 30 is not drawn to size, and may embody multiple different sizes and structures. The acoustic driver 32 can assist in converting the pressurized or compressed air from the compressor 30 to pressure pulses or sound waves, and can divert the sound waves to the elongated section 24. The pressureized air is delivered to the acoustic driver 32 by an electrically controlled solenoid valve (not shown) located between the compressor 30 and the acoustic driver. The compressor 30 may be attached to the acoustic driver 32 by a pipe, tube, or the like and can transmit pressurized or compressed air through the pipe to the acoustic driver 32. The acoustic driver 32 can be attached to the elongated section 24 by being removably attachable to a flange 34 positioned at an end of the elongated section 24. The flange may engage one or more screws such that the acoustic driver 32 can be attached to or removed from the elongated section 24. It is to be understood, however, that other attachment means are possible for attaching the elongated section 24 to the acoustic driver 32, such as a male-female threading attachment, a snap fit attachment, etc.

The operation of the acoustic cleaning system 10 shown in FIG. 2 can now be briefly described. Pressurized or compressed air can be provided from the compressor 30 to the acoustic driver 32. The pressure waves, in the form of sound waves, can then travel through the elongated section 24 before exiting through the horn section 22. Upon exiting the horn section 22, the sound waves pass through the holes 18 and into the interior portion 14 of the operating device 12. The sound waves may agitate and/or vibrate the particles 8 within the operating device 12, thus dislodging the particles from any interior walls or structures in the interior portion 14. Upon being dislodged, some of the particles may be airborne and can be removed by circulating flue gas through the operating device 12. It is to be understood that the frequency (f) of the sound waves can affect the ability of the acoustic cleaning device 20 to agitate and/or vibrate the particles. However, the frequency (f) of the sound waves can vary based on the temperature of the operating device 12. As will be described below, the frequency (f) of the sound waves can be controlled by varying the length and shape of the elongated section 24, thus minimizing the effects that high temperature has on frequency (f) in the operating device 12.

The speed of sound (C) is the distance traveled by a sound wave during a unit of time. At sea level with a temperature of 0° C., the speed of sound (C) is about 331 m/s. The speed of sound (C) can vary based on air temperature (T), wavelength (λ) of the sound wave, and frequency (f) of the sound wave. The equation for the speed of sound (C) with respect to temperature is: $C=331+\sqrt{1+0.00366*T}$. The equation for the speed of sound (C) with respect to the wavelength (λ) of the sound wave and frequency (f) of the sound wave is: $C=\lambda*f$. Consequently, $C=\lambda*f=331+\sqrt{1+0.00366*T}$. However, since the length of a horn is fixed, the wavelength (λ) of the sound wave will remain constant, and the frequency (f) will vary depending on the temperature (T). In high-temperature environments, such as the ones encountered with the operating device 12 in the present example, the frequency (f) will rise with the temperature. For instance, in an SCR operation with a temperature of about 700° F., an acoustic cleaning device operating at 75 Hz at 0° C. will emit sound waves having, a frequency (f) of 111 Hz when perceived at the elevated temperature. However, it is desired to keep the frequency (f) low, such as at 75 Hz or between the range of 55 Hz to 75 Hz. Therefore, in a high-temperature environment, a longer tube length may be used, which increases the wavelength (λ) of the sound wave and provides for a lower frequency (f). For instance, in the above described SCR operation with a temperature of about 700° F., adding 48" of length to the acoustic cleaning device 20 will produce a 75 Hz sound wave at elevated temperatures. Moreover, adding a longer section of 92" of length to the acoustic cleaning device 20 will produce a 55 Hz sound wave at elevated temperatures. Consequently, based on the temperature of the operating device 12, the length and shape of the acoustic cleaning device 20 can be built to produce a desired frequency. As such, FIGS. 3 to 9 show examples of an acoustic cleaning device 20 having a variety of lengths and shapes and will now be discussed. Accordingly, the elongated section of the acoustic cleaning device 20 is configured to tune and emit a frequency that is more effective at cleaning by providing sound waves having an optimal frequency.

Figure 3:
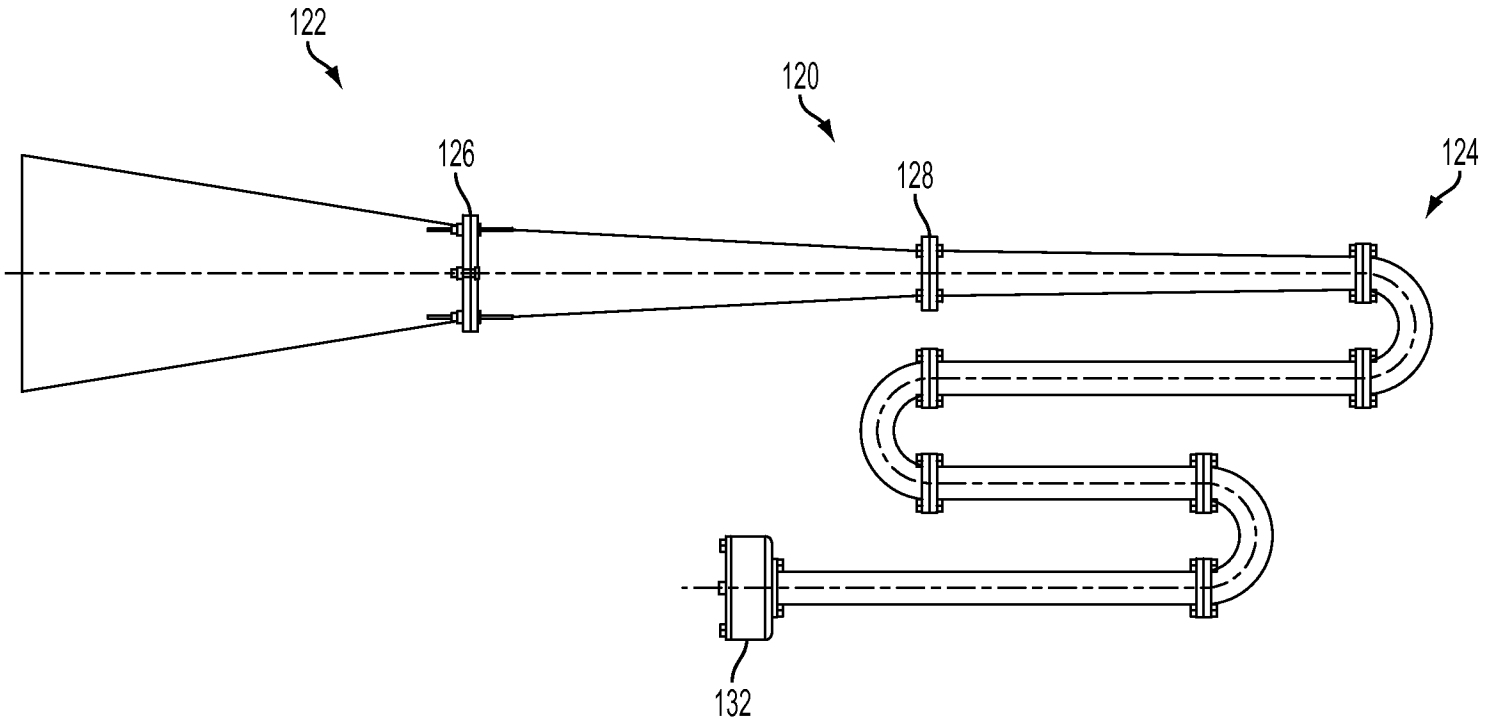
FIG. 3 is a perspective view of an example acoustic cleaning device having a multiple folded shape in accordance with an aspect of the present invention.
Figure 4:
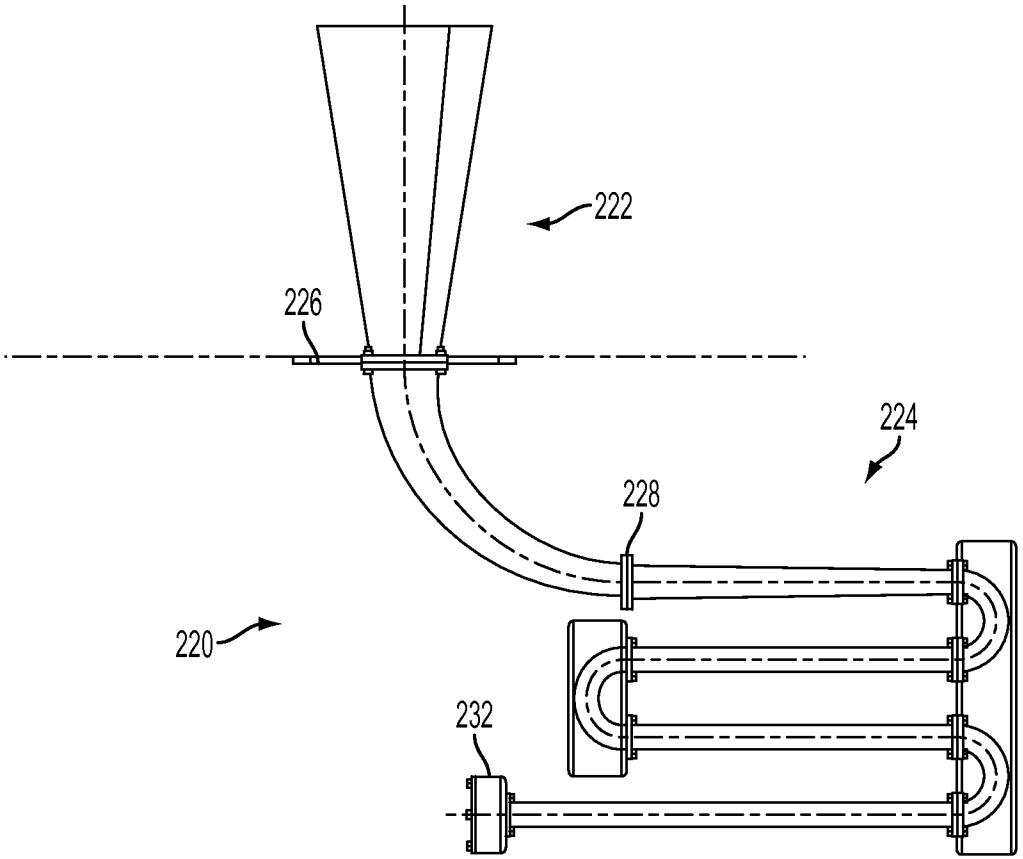
FIG. 4 is a perspective view of a second example acoustic cleaning device having a multiple folded shape in accordance with an aspect of the present invention.

Referring now to FIGS. 3 and 4, examples of an acoustic cleaning device are shown with both acoustic cleaning devices having a multiple folded shape with three passes. In FIG. 3, an acoustic cleaning device 120 is shown having a horn section 122 and an elongated section 124 that has a multiple folded shape with three passes. An acoustic driver 132 may be provided for engaging with a compressor (not shown) that provides compressed or pressurized air. The elongated section 124 may be oriented in a direction parallel to a direction of the horn section 122. The elongated section 124 can be attached to the horn section 122 by a flange 128. Other attachment means are envisioned, however, such as a male-female threading attachment, a snap fit attachment, etc. Additionally, the acoustic cleaning device 120 may include a flange 126 providing for attachment to the operating device 12 (not shown). In other examples, the acoustic cleaning device 220 may be formed as a single piece, such that the flanges are not necessary.

In FIG. 4, a horn section 222 is provided with an elongated section 224 also having a multiple folded shape with three passes. An acoustic driver 232 is provided for engaging with a compressor (not shown) that provides compressed or pressurized air. The elongated section 224 is oriented in a direction perpendicular to a direction of the horn section 222. As with the example shown in FIG. 3, the elongated section 224 can be attached to the horn section 222 by a flange 228. Other attachment means are envisioned, however, such as a male-female threading attachment, a snap fit attachment, etc. Additionally, the acoustic cleaning device 220 may include a flange 226 providing for attachment to the operating device 12 (not shown). In other examples, the acoustic cleaning device 220 may be formed as a single piece, such that the flanges are not necessary.

It is to be understood that the elongated section 124, 224 shown in FIGS. 3 and 4 can be of any length and may have more or less passes, such as four passes, two passes, etc. Due to space constraints, a straight elongated section of the length needed in FIGS. 3 and 4 may not be feasible, as a straight elongated section may not fit in the desired workspace. As such, the curved multiple folded shape of the elongated section 124, 224 can provide the desired length while reducing the size of the overall space needed to fit the elongated section 124, 224. Accordingly, the elongated section 124, 224 can extend farther or shorter in each direction, depending on the pre-determined length needed based on the temperature of the operating device 12. Furthermore, the shape and orientation of the elongated section 124, 224 may also change, depending on the application. For instance, the elongated section 124 in FIG. 3 is oriented in a direction parallel to a direction of the horn section 122 while the elongated section 224 in FIG. 4 is oriented in a direction perpendicular to a direction of the horn section 222. In other examples, the elongated section can be oriented at a non-parallel and non-perpendicular angle to the horn section 222, such as at a 45° angle, or the like.

Figure 5:
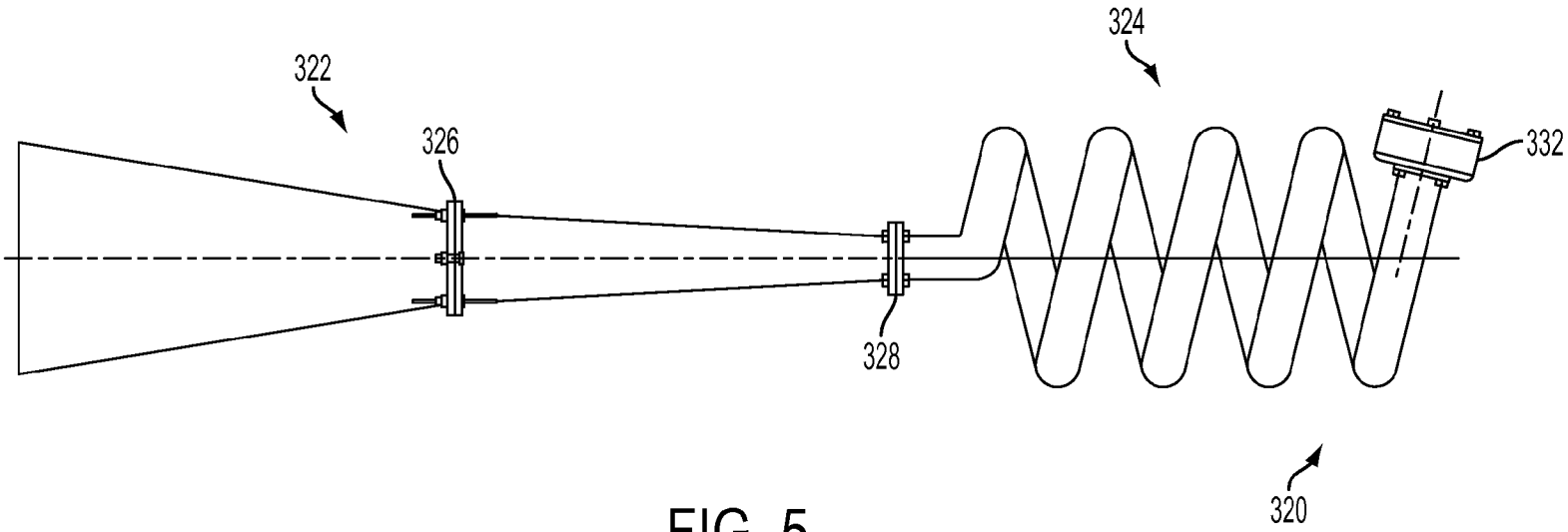
FIG. 5 is a perspective view of an example acoustic cleaning device having a helix shape in accordance with an aspect of the present invention.
Figure 6:
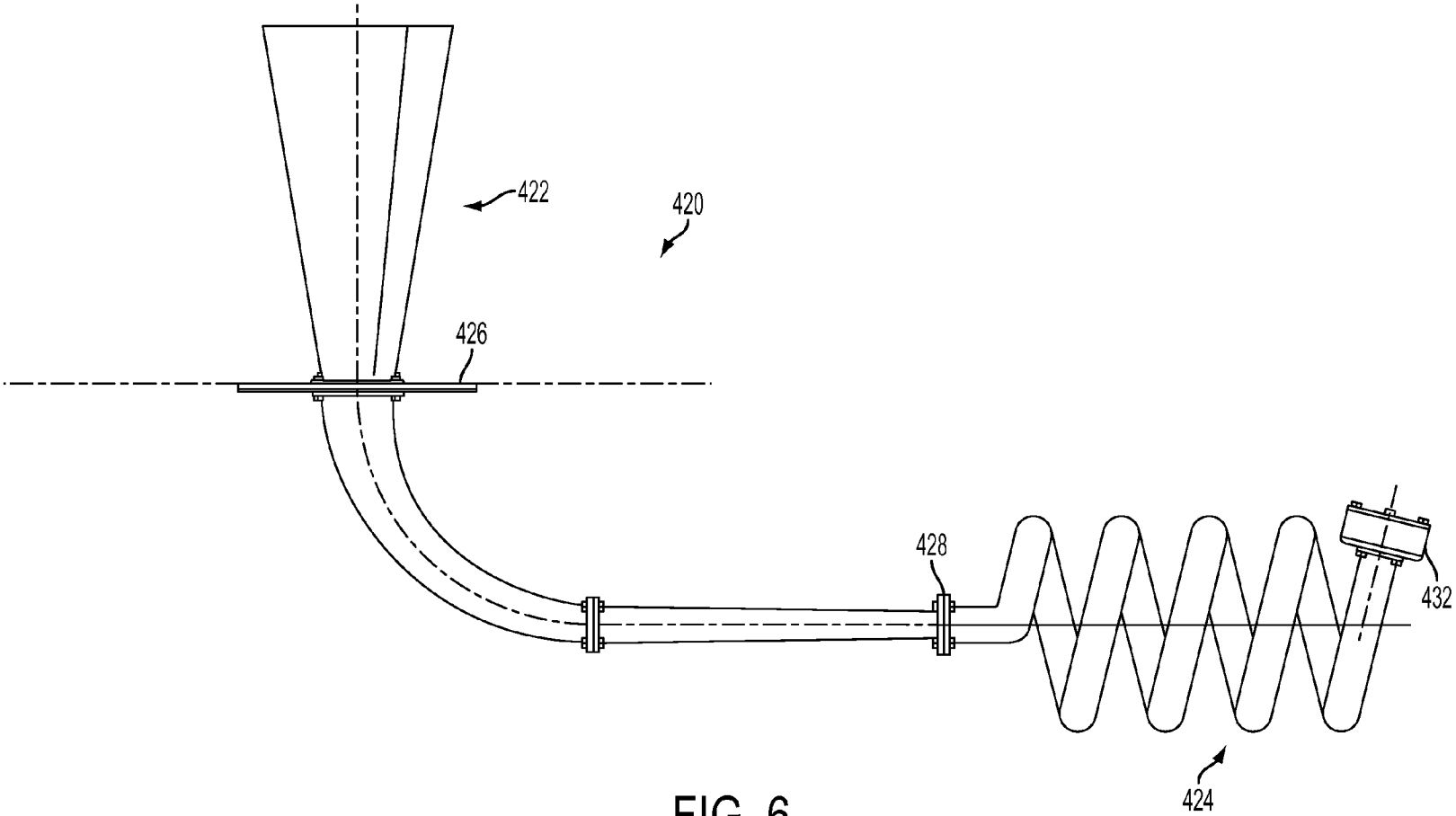
FIG. 6 is a perspective view of a second example acoustic cleaning device having a helix shape in accordance with an aspect of the present invention.

Referring now to FIGS. 5 and 6, example acoustic cleaning devices are shown with both example acoustic cleaning devices shaped in the form of a helix. In FIG. 5, an acoustic cleaning device 320 is shown having an elongated section 324 that has a helical shape. An acoustic driver 332 is provided for engaging with a compressor (not shown). The elongated section 324 may be oriented in a direction parallel to the direction of a horn section 322. The elongated section 324 can be attached to the horn section 322 by a flange 328. Other attachment means are envisioned, however, such as a male-female threading attachment, a snap fit attachment, etc. Additionally, the acoustic cleaning device 320 may include a flange 326 providing for attachment to the operating device 12 (not shown). In other examples, the acoustic cleaning device 320 may be formed as a single piece, such that flanges are not necessary.

In FIG. 6, a horn section 422 is provided with an elongated section 424 also having a helical shape. An acoustic driver 432 is provided for engaging with a compressor (not shown) that provides compressed or pressurized air. The elongated section 424 is oriented in a direction perpendicular to a direction of the horn section 222. As with the example shown in FIG. 5, the elongated section 424 can be attached to the horn section 422 by a flange 428. Other attachment means are envisioned, however, such as a male-female threading attachment, a snap fit attachment, etc. Additionally, the acoustic cleaning device 420 may include a flange 426 providing for attachment to the operating device 12 (not shown). In other examples, the acoustic cleaning device 420 may be formed as a single piece, such that flanges are not necessary.

It is to be understood that the elongated section 324, 424 shown in FIGS. 5 and 6 can be of any length and may have more or less helical turns, such as a single helical turn, or multiple helical turns. Due to space constraints, the straight elongated section of the length needed may not be feasible. As such, the helical shape of the elongated section 324, 424 can provide the desired length while also reducing the overall space needed. Accordingly, the elongated section 324, 424 can extend farther or shorter in each direction, depending on the pre-determined length needed based on the temperature of the operating device 12. Furthermore, the shape and orientation of the elongated section 324, 424 can vary, such as being oriented in a direction that is non-parallel and non-perpendicular to the direction of the horn section, such as at a 45° angle, or the like.

Figure 7:
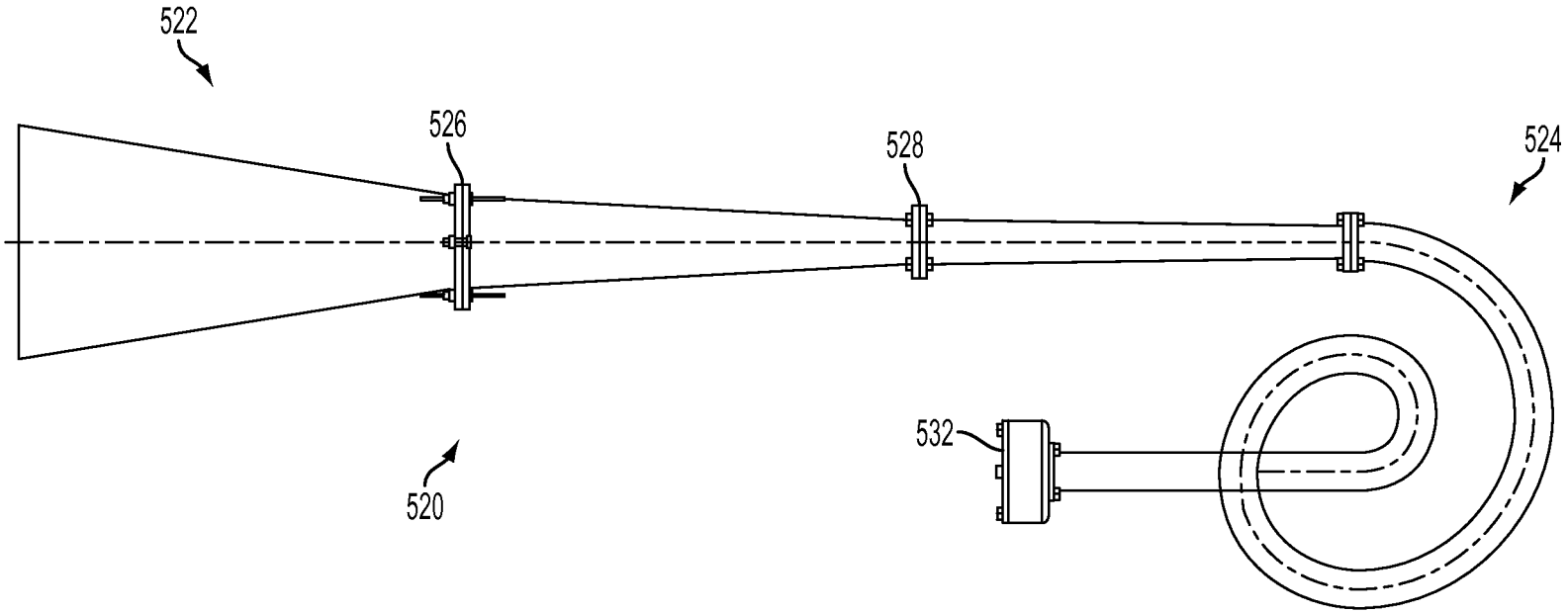
FIG. 7 is a perspective view of an example acoustic cleaning device having a spiral shape in accordance with an aspect of the present invention.
Figure 8:
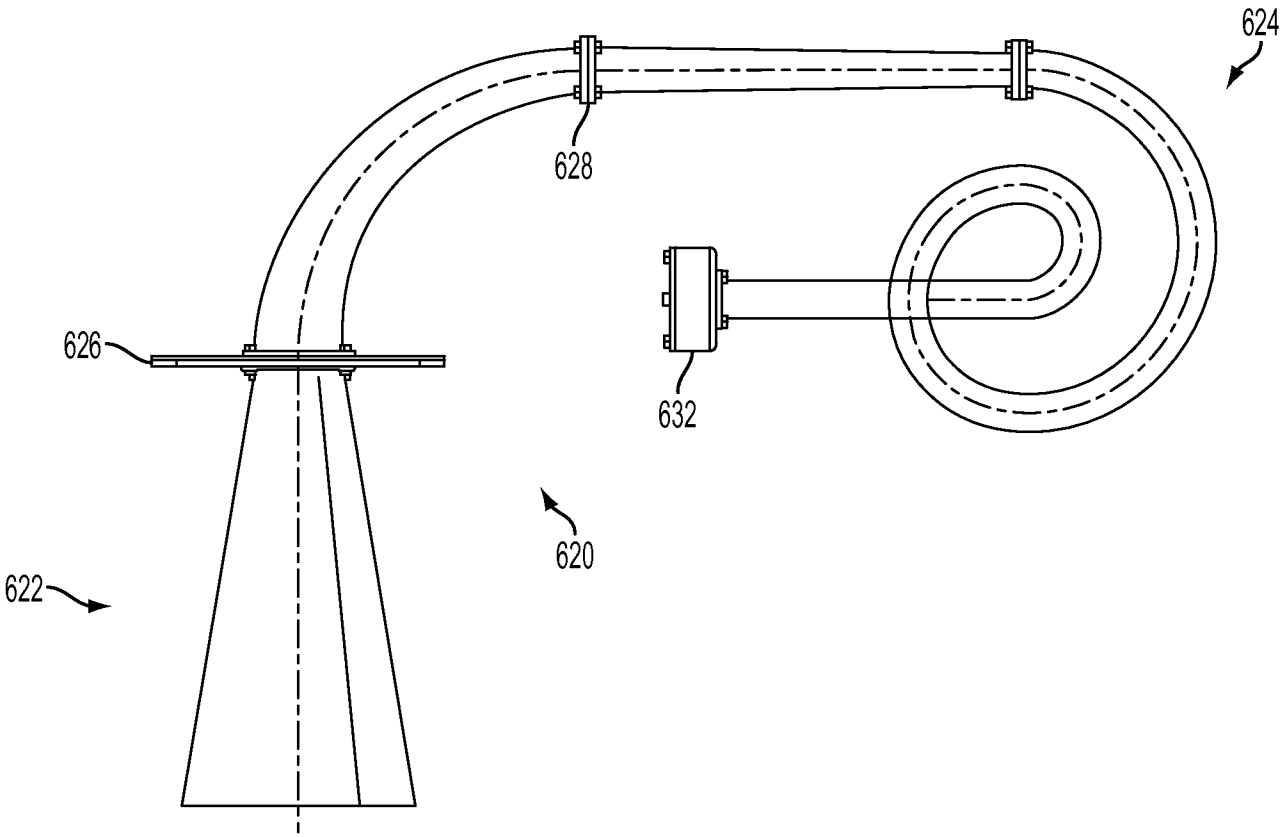
FIG. 8 is a perspective view of a second example acoustic cleaning device having a spiral shape in accordance with an aspect of the present invention.

Referring now to FIGS. 7 and 8, example acoustic cleaning devices are shown with both example acoustic cleaning devices having a spiral shape. In FIG. 7, an acoustic cleaning device 520 is shown having a horn section 522 and an elongated section 524 that has a spiral shape. An acoustic driver 532 is provided for engaging with a compressor (not shown). The elongated section 524 may be oriented in a direction parallel to the direction of the horn section 522. The elongated section 524 can be attached to the horn section 522 by a flange 528. Other attachment means are envisioned, however, such as a male-female threading attachment, a snap fit attachment, etc. Additionally, the acoustic cleaning device 520 may include a flange 526 providing for attachment to the operating device 12 (not shown). In other examples, the acoustic cleaning device 520 may be formed as a single piece, such that the flanges are not necessary.

In FIG. 8, an acoustic cleaning device 620 is shown having a horn section 622 attached to an elongated section 624 also having a spiral shaper. An acoustic driver 632 is provided for engaging with a compressor (not shown) that provides compressed or pressurized air. The elongated section 624 is oriented in a direction perpendicular to the direction of the horn section 622. As with the previous examples, the elongated section 624 can be attached to the horn section 622 by a flange 628. Other attachment means are envisioned, however, such as a male-female threading attachment, a snap fit attachment, etc. Additionally, the acoustic cleaning device 620 may include a flange 626 providing for attachment to the operating device 12 (not shown). In other examples, the acoustic cleaning device 620 may be formed as a single piece, such that the flanges are not necessary.

As with the examples shown in FIGS. 3-6, the elongated section 524, 624 can be of any length and may have more or less spiral turns. Due to space constraints, the spiral turns may allow a long elongated section to fit into a smaller space. The elongated sections can be longer or shorter than the elongated section 524, 624 shown in FIGS. 7 and 8, depending on the pre-determined length needed based on the temperature of the operating device 12. Furthermore, the shape and orientation of the elongated section 524, 624 can vary, such as being oriented in a direction that is non-parallel and non-perpendicular to the direction of the horn section, such as at 45° angle, or the like.

Figure 9:
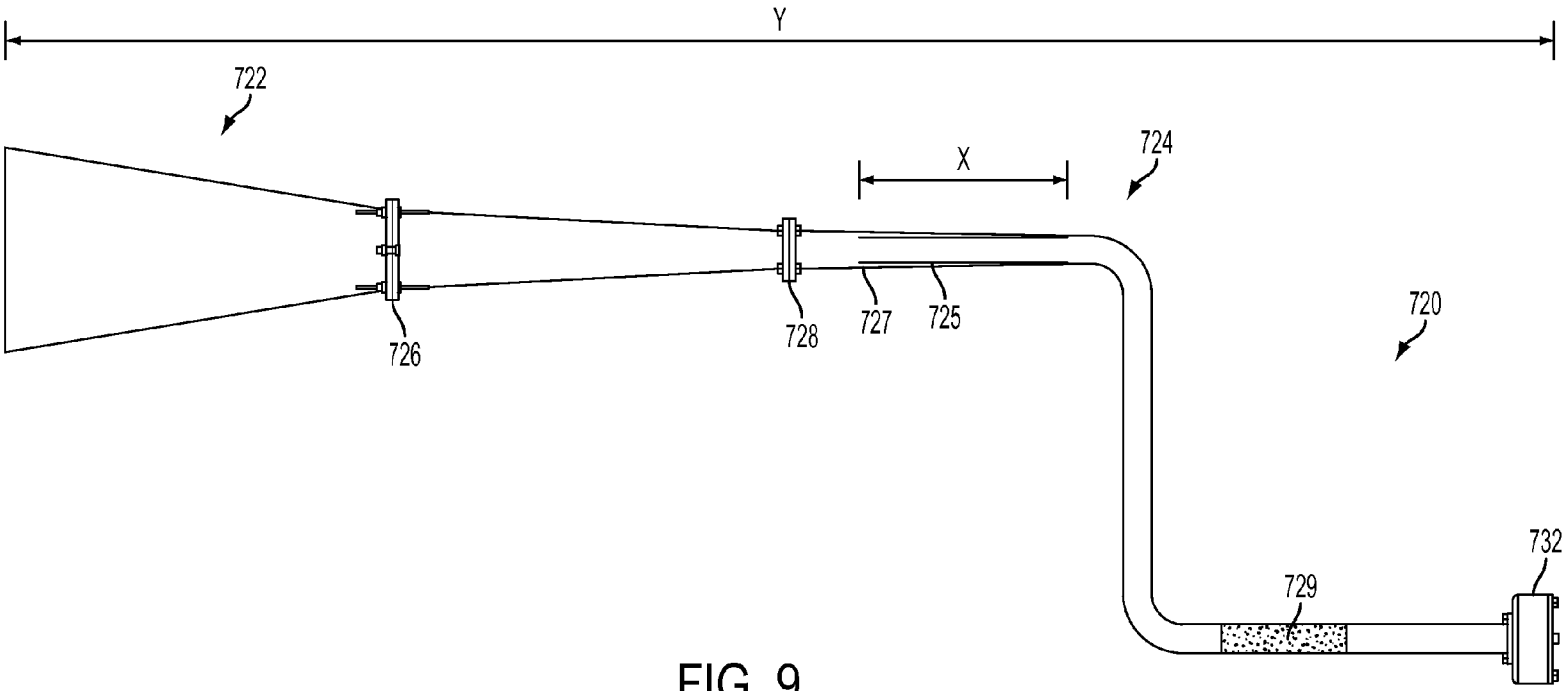
FIG. 9 is a perspective view of an example acoustic cleaning device having a folding shape in accordance with an aspect of the present invention.

Referring now to FIG. 9, an example acoustic cleaning device 720 is shown having a folding shape. The acoustic cleaning device 720 includes a horn section 722 attached to an elongated section 724. An acoustic driver 732 is provided for engaging with a compressor (not shown). A flange can removably attach the elongated section 724 to the horn section 722. Additionally, a flange 726 can removably attach the horn section 722 to the operating device 12 (not shown). Alternatively, the elongated section 724 and horn section 722 can be formed as a single piece, such that the flange 728 is not necessary. In the shown example, the elongated section 724 has a folding shape with two substantially 90° bends. It is to be understood, however, that the bends in the elongated section 724 can have varying angles, such as a 0° to 89° angle. Moreover, the elongated section 724 can have more than or less than the two bends shown in FIG. 9. Additionally, while the elongated section 724 is shown to be oriented in a direction parallel to the direction of the horn section 722, the elongated section 724 can be oriented in any number of directions, depending on the application. In one example, the elongated section can be oriented in a direction perpendicular to the direction of the horn section 722.

The example acoustic cleaning device 720 shown in FIG. 9 can include the elongated section 724 having an adjustable length device. The adjustable length can be accomplished in a number of ways, and will allow a user to change the effective length of the elongated section 724 without having to remove the elongated section 724 from the horn section 722. For instance, in the shown example, the adjustable length can be accomplished by a telescoping section including a male portion 725 and a female portion 727. In the telescoping section, a male portion 725 of the elongated section 724 can have a smaller diameter than a female portion 727. Accordingly, the male portion 725 can adjustably slidably and telescopingly engage the female portion 727 such, that the male portion 725 is insertable into the female portion 727. The horn section 722 can be substantially conically shaped, such that the diameter of the female portion 727 is larger than the diameter of the male portion 725 of the elongated section. In the shown example of FIG. 9, the male portion 725 can slide into the female portion 727 by a certain distance, shown as X. Accordingly, the male portion 725 can be slid partially or completely into the female portion 727, thereby varying the length of the elongated section 724 and, thus, the overall length, shown as Y, of the acoustic cleaning device 720.

It is to be understood that the adjustable length telescoping section is not limited to the example shown in FIG. 9 and can be used in any of the examples shown and described herein. For instance, in any of the shown or described examples, an elongated section can be provided with a male portion having a diameter that is smaller than a female portion. Similarly, the length of the male and female portions are not limited to the distance, shown as X, shown herein, and could be longer or shorter. Furthermore, more than one adjustable length telescoping section can be included on a single elongated section.

The adjustable length of the example acoustic cleaning device 720 shown in FIG. 9 can be accomplished in a variety of ways. In addition to the telescoping section, the example acoustic cleaning device 720 can also include a compressible section 729. The compressible section 729 can include a variety of compressible materials, such as an elastomer, or the like. The compressible section 729 can define a hollow, circular elongated section positioned anywhere along the elongated section 724. Accordingly, the compressible section 729 can be compressed, such that the length of the acoustic cleaning device 720 can be shortened. Similarly, the compressible section 729 can be elongated, such that the length of the acoustic cleaning device 720 can be lengthened. The compressible section 729 can have a variety of lengths, such that a shorter length provides less compressibility while a longer length provides more compressibility.

Similar to the adjustable length telescoping section shown in FIG. 9, the compressible section 729 can be provided in any of the examples shown and described herein. For instance, in any of the shown or described examples, an elongated section can be provided with the compressible section 729. Similarly, one or more compressible sections can be provided on a single elongated section. Accordingly, both a telescoping section and a compressible section can be provided on a single elongated section, with one or more of each of the telescoping sections and compressible sections being provided. As such, the user of the acoustic cleaning device can adjust the length at any time with the variable length devices.

Figure 10:
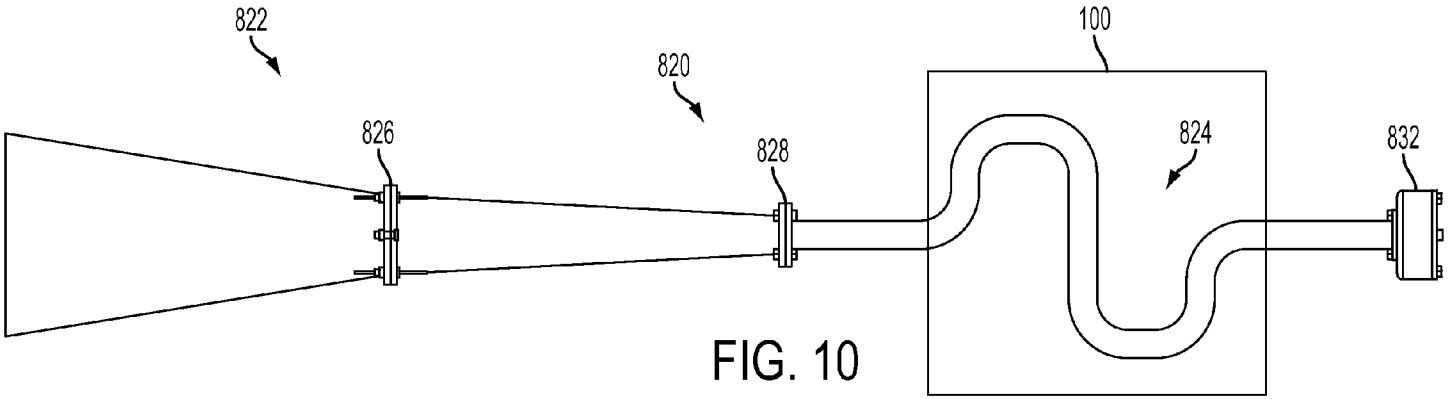
FIG. 10 is a perspective view of an example acoustic cleaning device having a multiple folded shape and surrounded by a compact assembly.

Referring now to FIG. 10, an example acoustic cleaning device 820 is shown having a multiple folded shape. The acoustic cleaning device 820 includes a horn section 822 attached to an elongated section 824. An acoustic driver 832 is provided for engaging with a compressor (not shown). A flange can removably attach the elongated section 724 to the horn section 722. Additionally, a flange 826 can removably attach the horn section 822 to the operating device 12 (not shown). Alternatively, the elongated section 824 and horn section 822 can be formed as a single piece, such that the flange 828 is not necessary. In the shown example, the elongated section 824 has a folding shape with five substantially 90° bends. It is to be understood, however, that the bends in the elongated section 724 can have varying angles, such as a 0° to 89° angle. Moreover, the elongated section 724 can have more than or less than the five bends shown.

Figure 11:
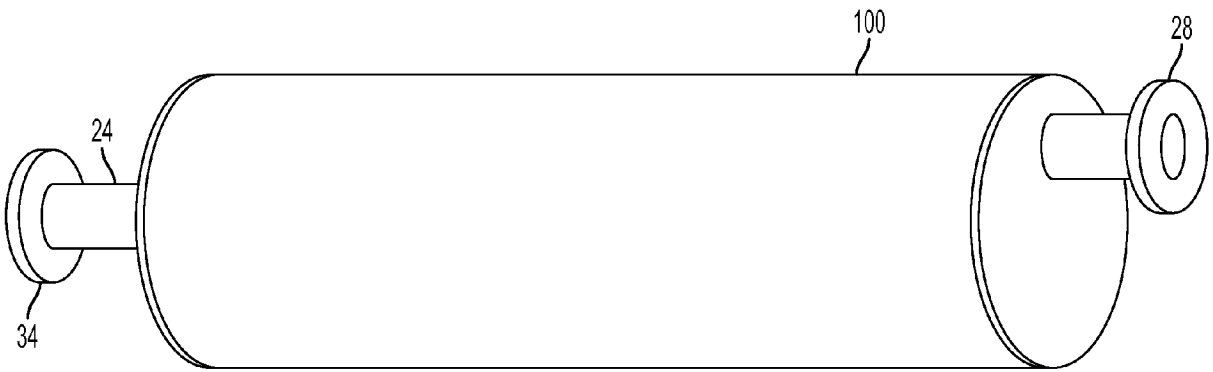
FIG. 11 is a perspective view of an example acoustic cleaning device surrounded by a compact assembly.

Referring now to FIGS. 10 and 11, any of the example acoustic cleaning devices can include a compact assembly 100 configured to surround the elongated section. For instance, in the example shown in FIG. 10, the compact assembly 100 surrounds the elongated section 824 having five substantially 90° bends. However, it is to be understood that the compact assembly 100 is not limited to the shown example, and can be used interchangeably with any of the examples of elongated sections shown in FIGS. 2-9. Furthermore, the compact assembly 100 can take a variety of shapes and sizes, depending on the shape of the specific elongated section. For instance, in the shown example of FIG. 11, the compact assembly 100 is substantially cylindrically shaped. However, the compact assembly 100 can be square shaped, rectangularly shaped, etc. Moreover, the compact assembly 100 can be made of a variety of materials, such as metal, including stainless steel, titanium, or the like. The compact assembly 100 may be formed as a single integrally formed piece, or may be formed from multiple pieces attached together, such as by welding or the like.

The compact assembly 100 is configured to encompass, and surround all or substantially all of the specific elongated section. Accordingly, one end of the elongated section can protrude from an end of the compact assembly 100 while the other end of the elongated section can protrude from an opposing end of the compact assembly 100. As such, in the example shown in FIG. 11, the flange 28 can be attached to the horn section 22 while the flange 34 can be attached to the acoustic driver 32. Consequently, the elongated section 24 can remain covered by the compact assembly 100 while being attached. Further, the compact assembly 100 may include one or more openings configured to allow the ends of the elongated section to protrude. Additionally, the one or more openings may be positioned out of alignment, similar to the example shown in FIG. 11, or may be positioned in line, similar to the example shown in FIG. 10.

The operation of the acoustic cleaning system 10 will now be described. As described above, the acoustic cleaning device 20 can be used with a number of different operating devices, including a variety of high-temperature devices. These include, but are not limited to, boilers, heat exchangers, selective catalyst reduction (SCR), electrostatic precipitator (ESP), baghouses, cooling towers, spray towers, fans, etc. The individual temperatures of each of the above mentioned devices may vary, such as from 700° F. in SCR devices to 1000° F. and higher for boilers and heat exchangers. The acoustic cleaning device 20 can emit a sound wave into the interior portion 14 that agitates and vibrates particles resting on walls or structures in the operating device 12. The agitation and vibration can assist in removing the particles by means of a flue gas pumped through the operating device 12.

The frequency (f) of the sound waves emitted from the acoustic cleaning device 20 may be higher with the operating device 12 at a higher temperature and may vary from one operating device to another based on different temperatures. As such, an acoustic cleaning device 20 may produce a sound wave having a certain frequency (f) into the operating device 12. However, in a separate operating device with a different temperature, the same acoustic cleaning device 20 may produce a sound wave having a different frequency (f). To address this issue, the acoustic cleaning device 20 may include an elongated section 24 of varying length and shape attached to a horn section 22. As shown from FIG. 2 to FIG. 9, the elongated section 24 may have a variety of shapes and lengths, depending on the individual operating device and temperature. For instance, in one example, with the operating device 12 having a temperature of about 700° F., an elongated section 24 having 48" of length may produce a 75 Hz sound wave. Moreover, an elongated section 24 having 92" of length can produce a 55 Hz sound wave in the same application. Therefore, the acoustic cleaning device 20 can be modified, such as by removing an elongated section and replacing it with a separate elongated section based on the temperature of the operating device 12. In the alternative, an entire acoustic cleaning device can be removed and replaced with a separate acoustic cleaning device having a different overall length. As such, a frequency between the range of 55 Hz and 75 Hz can be obtained even in operating devices having varying high temperatures.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An acoustic cleaning device providing sound waves to an interior portion of an operating device having an operating temperature, with the interior portion being bounded by at least one wall, the acoustic cleaning device including:

a horn section configured to emit sound waves;

an attachment attaching the horn section to the at least one wall of the operating device; and an elongated section attached to the horn section, wherein a length of the elongated section is configured to be adjustable and the length selected depending on a temperature of the operating device;

wherein the horn section is in operative association with the operating device via the attachment attaching the horn section to the at least one wall of the operating device, further wherein the sound waves emitted from the horn section are configured to pass into the interior portion of the operating device to agitate particles within the operating device, and wherein the elongated section is removable from the horn section such that the elongated section is interchangeable with an elongated section having a different length.

2. The acoustic cleaning device of claim 1, further including an acoustic driver attached to the elongated section, wherein the acoustic driver is configured to convert compressed air into the sound waves and deliver the sound waves to the elongated section.

3. The acoustic cleaning device of claim 1, wherein the elongated section includes a telescoping section including a male portion and a female portion, further wherein the male portion is configured to be adjustably slidable within the female portion, such that the length of the elongated section is adjustable.

4. The acoustic cleaning device of claim 1, wherein sound waves are configured to pass through the elongated section and be emitted to the horn section.

5. The acoustic cleaning device of claim 4, wherein the emitted sound waves have a frequency between 55 Hz to 75 Hz within the operating device.

6. The acoustic cleaning device of claim 5, wherein the sound waves have a frequency between 55 Hz to 75 Hz depending on a temperature of the operating device.

7. The acoustic cleaning device of claim 4, wherein the elongated section is configured to tune the frequency emitted to be more effective at cleaning.

8. The acoustic cleaning device of claim 1, wherein the elongated section has a helix shape.

9. The acoustic cleaning device of claim 1, wherein the elongated section has a spiral shape.

10. The acoustic cleaning device of claim 1, wherein the elongated section has a folding shape.

11. The acoustic cleaning device of claim 1, wherein the elongated section is attached to the horn section by a flange.

12. The acoustic cleaning device of claim 1, wherein the elongated section is configured to be surrounded by a compact assembly.

13. An acoustic cleaning system including:

an operating device including an interior portion bounded by at least one wall of the operating device, the operating device having an operating temperature;

an acoustic cleaning device in operative association with the operating device, the acoustic cleaning device including:

a horn section attached to an elongated section, wherein sound waves are configured to pass from the elongated section to the horn section and into the interior portion of the operating device;

an attachment attaching the horn section to the at least one wall of the operating device;

wherein the elongated section is removable from the horn section, further wherein the elongated section is interchangeable with an elongated section having a different length, and the different length being selected depending on a temperature of the operating device such that the sound waves are configured to have a frequency between 55 Hz to 75 Hz depending on a temperature of the operating device.

14. The acoustic cleaning device of claim 13, wherein a length of the elongated section is configured to be adjustable.

15. The acoustic cleaning device of claim 13, wherein the acoustic cleaning system further includes a compressor in operative association with the elongated section configured to push air through the elongated section.

16. The acoustic cleaning device of claim 13, wherein the elongated section has a helix shape.

17. The acoustic cleaning device of claim 13, wherein the elongated section has a spiral shape.

18. The acoustic cleaning device of claim 13, wherein the elongated section is configured to be surrounded by a compact assembly.

* * * * *